US005234356A

United States Patent [19]

Maejima et al.

[11] Patent Number: 5,234,356

[45] Date of Patent: Aug. 10, 1993

[54] CONNECTOR

[75] Inventors: Toshiro Maejima; Tetsuro Saimoto, both of Shizuoka, Japan

[73] Assignee: Yazaki Corporation, Tokyo, Japan

[21] Appl. No.: 779,530

[22] Filed: Oct. 18, 1991

[30] Foreign Application Priority Data

Oct. 22, 1990 [JP] Japan ..... 2-109763[U]

[51] Int. Cl.[5] ..... H01R 13/627

[52] U.S. Cl. ..... 439/352; 439/357

[58] Field of Search ..... 439/345, 346, 347, 350, 439/351, 352, 353, 354, 357, 358, 488

[56] References Cited

U.S. PATENT DOCUMENTS 4,711,511 12/1987 Noorily ..... 439/352 X 4,946,395 8/1990 Cope et al. ..... 439/357 X 4,950,179 8/1990 Takenouchi et al. ..... 439/352

*Primary Examiner*—Larry I. Schwartz

*Assistant Examiner*—Khiem Nguyen

*Attorney, Agent, or Firm*—Sughrue, Mion, Zinn, Macpeak & Seas

[57] ABSTRACT

A connector comprise a pair of connector housings including one connector housing including a flexible arm having an engaging projection and the other connector housing including an engaging portion corresponding to the engaging projection; lock release prevention device for locking the connector housings to each other by moving the lock release prevention device from a temporary engaging position to a completely engaging position; and an accommodating device, formed on the other connector housing, for accommodating the lock release prevention device.

5 Claims, 7 Drawing Sheets

CONNECTOR

BACKGROUND OF THE INVENTION

The present device relates to a connector which avoids the release of the lock condition by engaging a flexible engaging arm provided on a connector housing with a lock member.

FIG. 11 is a disassembled perspective view showing a connector disclosed in Japanese Examined Published Utility Model Application No. 57-49913.

The connector comprises a female connector housing 50 which is provided with a flexible arm 52 having an engaging projection 51 as a lock means and a male connector housing 53 which is provided with an engaging frame 54 for engaging the flexible arm 52. The connector further comprises a lock release prevention means such as a lock member 56 which is inserted into a deformation space 55 of the flexible arm 52 under the condition that the engaging frame is engaged with the flexible arm 52. The lock member 56 is formed by providing a U-shaped frame piece 58 having a pair of locking claws at its both ends thereof and a lock piece 60, which has an arrowhead portion 59, protruding from the center or the U-shaped frame.

FIG. 12 is a perspective view showing the engaging condition of the lock member 56. The locking claws 57 and the arrowhead portion 59 are engaged with the engaging frame 54 to fill the deformable space 55 with the lock member 56 thereby preventing the flexible arm 52 from being released from lock.

However, the structure of the conventional connector is disadvantageous in that, once the lock member 56 is engaged with the mating portion, it is extremely difficult to release the lock member 56 and it is also difficult to disconnect connectors 61 and 62 in maintenance work. There is also a problem that the lock member 56 is provided separately from the connector 62 and therefore the lock member 56 can be misplaced and the mounting can be troublesome.

SUMMARY OF THE INVENTION

In view of the forgoing problem, an object of the present invention is to provide a connector capable of easily preventing the lock condition from being released without losing the lock member and releasing the lock condition. Moreover, when the engagement of connector is incomplete, the connector of the present invention is performed to avoid the disconnection of the connector by detecting incomplete engagement of the connector.

A first aspect of the invention is to provide a connector comprising a connector housing provided with a flexible arm having an engaging projection and another connector housing provided with an engaging portion for the engaging projection, a lock member accommodating portion formed by providing a ceiling portion at an end portion of the flexible arm and a guide wall having a stopper projection and a flexible operating piece, which can advance toward the deforming side of the ceiling portion, moved from a temporary engaging position to a completely engaging position and fitted to the lock member accommodating portion.

A second aspect of the invention is to provide a connector comprising one connector housing provided with a flexible arm having an engaging projection and another connector housing provided with an engaging portion for the engaging projection, a stepped portion, provided on the outer wall of the one connector housing, opposing to the flexible arm, and a lock member having a protrusion which contacts the stepped portion when the flexible arm is deflected and which contacts the outer wall when the flexible arm is released, the lock member, provided with the flexible arm, to be freely slidable from the temporary engaging position to the final engaging position.

With the above construction, if the connector is incompletely engaged, the lock member cannot be inserted since the lock member interferes with the ceiling portion of the flexible arm which is deformed. On the other hand, if the lock member is to be slid toward the flexible arm which is similarly deflected, the projection formed on the lock member contacts the stepped portion to prevent the lock member from being slid. Therefore, incomplete engagement of the connector is thus detected.

Moreover, the lock condition can be easily released by disengaging the engaging portion from the stopper projection, by sliding to reset the lock member. Since the lock members are slidably mounted between the temporary engaging position and the final engaging position, they will not be misplaced and operation is also easy.

DETAILED DESCRIPTION OF THE PREFERRED EMBODIMENTS

The invention will now be described in detail with reference to the drawings.

Figure 1:
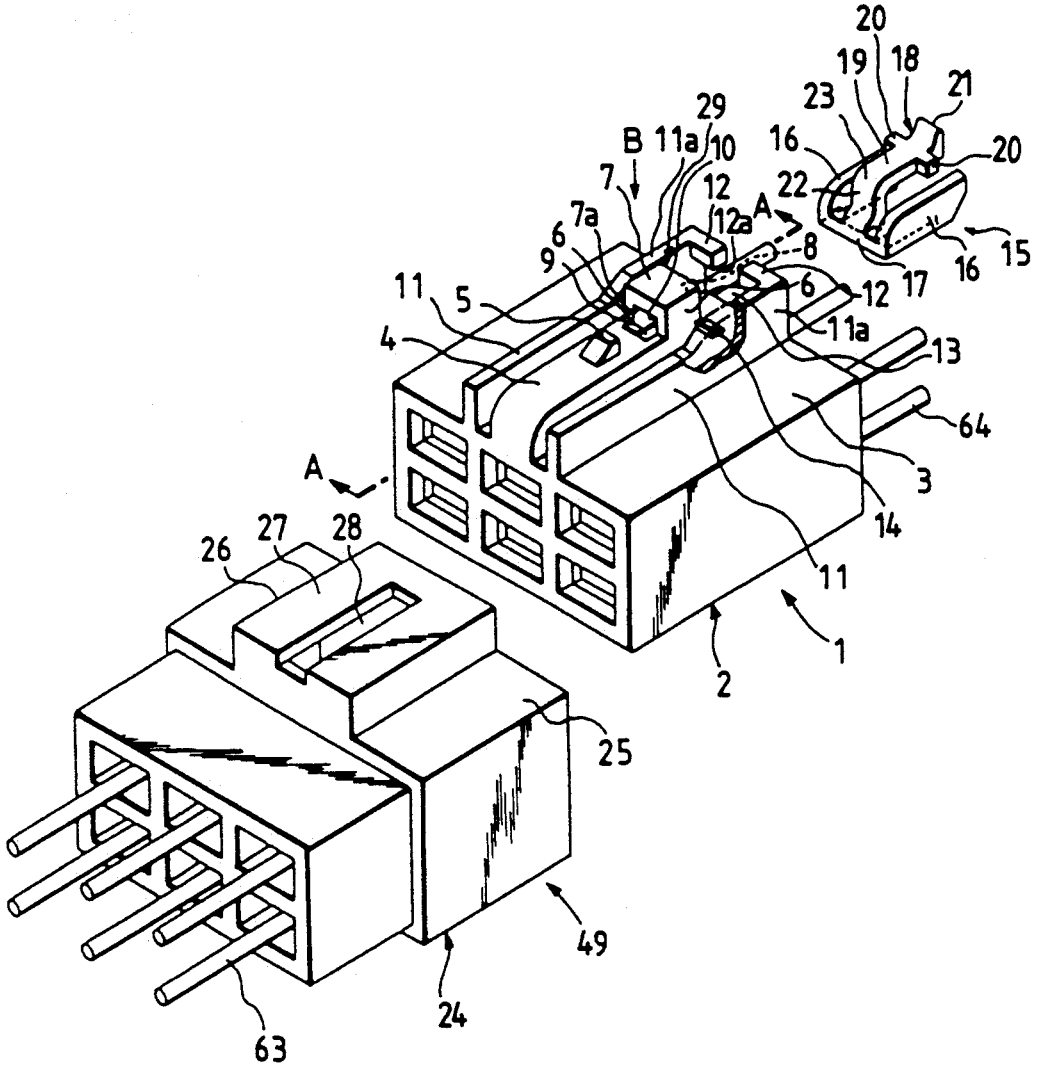
FIG. 1 is a disassembled perspective view showing the first embodiment of the present invention.

As shown in FIG. 1, the reference numeral 1 designates a male connector, a flexible arm 4 is integrally provided with an upper wall 3 of a male connector housing 2 made of a synthetic resin in the longitudinal direction from the end portion which is confronted to a female connector 49. The flexible arm 4 includes a engaging projection 5 at an intermediate portion thereof, and a push button portion 29 consisting of side walls 6 vertically formed on an end portion, opposite to the female connector 49, of the flexible arm, and ceiling wall 7 integrally disposed on the side walls 6. The push button portion 29 has a space 10 which is assessed by opening an end portion 8 and a bottom portion 9 formed in the push bottom portion 29.

In addition, a pair of guide walls 11, 11 are vertically provided along both sides of the flexible arm 4 on the upper wall 3 of the male connector housing 2, and a pair of opposing stopper projections 12 are provided at the upper edges of the end portions of guide walls 11*a* extending higher than the push button portion 29 to form the accommodating space 13 for the lock member 15, described later. The temporary engaging projection 14 corresponding the lock member 15 is provided on the upper wall 3.

The lock member 15, made of a synthetic resin, is provided with a coupling portion 17 formed at the front ends of both opposing side walls 16, a L-shaped flexible operating piece 18 extending upwardly from the coupling portion 17, a pair of engaging projections 20, for engaging the stopper projections 12, formed at both sides of the intermediate portion of an upper piece 19 of the operating piece 18, and an operating portion 21 protruding at an end portion of the upper piece 19.

In this structure, the side walls 16 are set to a height approaching the height of the lower surface 12*a* of the stopper projection 12 formed on the guide wall 11*a* and a width which allow the lock member to be smoothly inserted between the guide walls 11*a*. The width of the flexible operating piece 18 is designed to allow entry of the flexible operating piece 18 into the space 10 of the flexible arm 4. In such a position, the upper piece 19, (i.e., the intersection portion 23 of the vertical piece 22 and the piece 19) approaches the lower surface 7*a* of the ceiling portion 7.

As shown in FIG. 1, the female connector 49 includes an accommodating portion 26 for accommodating the flexible arm 4, provided on the upper wall 25 of the male connector accommodating chamber of the female connector housing 24 and an engaging opening 28, for engaging the engaging projection 5 of the flexible arm 4, provided on the upper wall 27 of the accommodating portion 26. Male and female terminals 49 and 1 connected to wires 63 and 64 are accommodated inside the female connector 49 and male connector 1.

Figure 2:
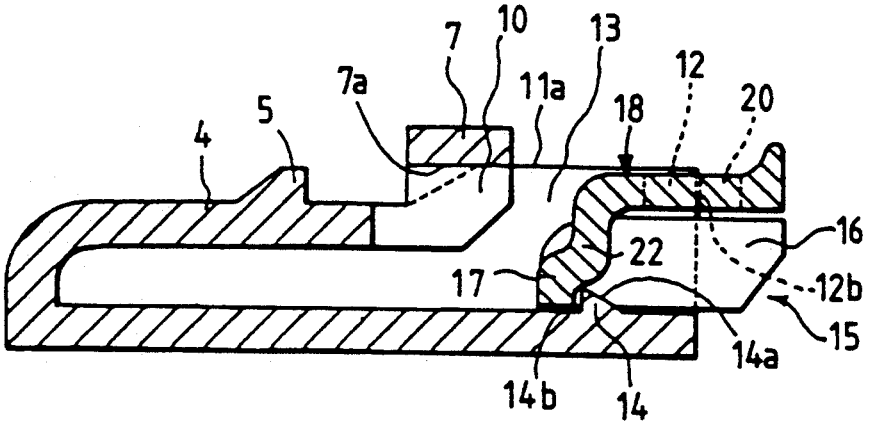
FIG. 2 is a cross sectional view along line A—A in FIG. 1.
Figure 3:
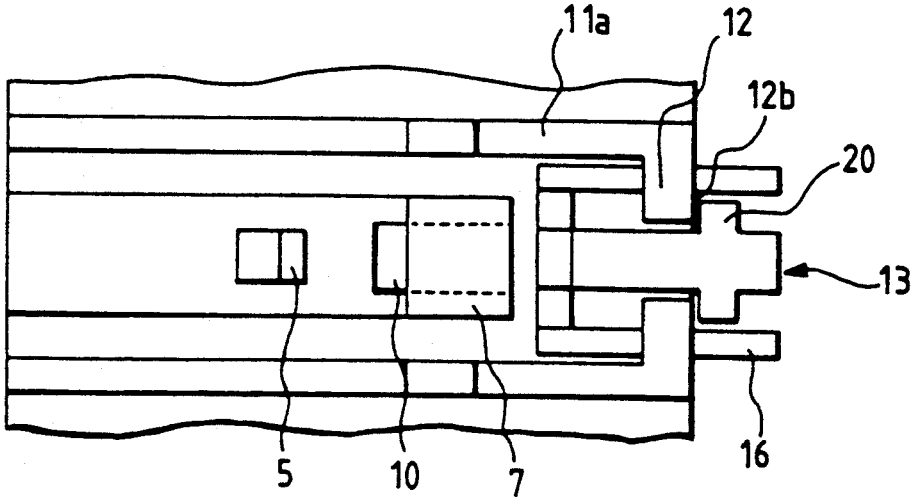
FIG. 3 is a plan view of the FIG. 1 in b direction.

FIG. 2 is a vertical cross sectional view, taken along line A—A in FIG. 1, showing the lock member 15 temporarily engaged in the accommodating portion space 13 and FIG. 3 is a plan view of the lock member 15 (equivalent to the B view in FIG. 1).

When the lock member 15 is inserted into the accommodating space 13, the side wall 16 moves along the guide wall 11*a* and the stopper projection 12, and the front end coupling portion 17 is engaged with the vertical surface 14*b* beyond the inclined surface 14*a* of the temporary engaging projection 14. In addition, the engaging projection 20 of the flexible operating piece 18 comes in contact with the front end 12*b* of the stopper projection 12.

Figure 4:
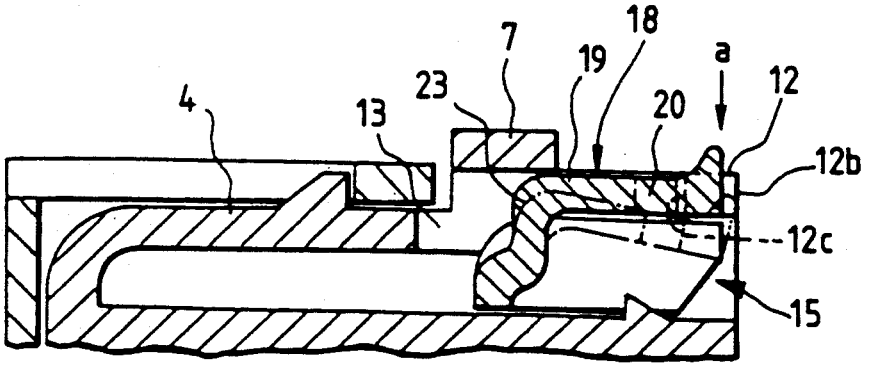
FIG. 4 is a vertical cross sectional view showing the connector prevented from releasing of lock condition.

As shown in FIG. 4, the flexible operating piece 18 of the lock member 15 is deformed by depressing the flexible operating piece 18 downwardly ("a" direction), allowing the lock member 15 to be slid in the accommodating space 13 due to the release of the connection between the engaging projection 20 and the stopper projection 12. Thereafter, the vertical piece 22 of the flexible operating piece 18 is positioned below (the, deformation side) the ceiling 7 and the lock member 15 can be completely engaged by restoring the position of the flexible operating piece 18 to such that the engaging projection 20 contacts the rear end 12*c* of the stopper projection 12. As a result, the releasing of the lock condition is effectively prevented due to the inability to deform the flexible arm 4. To subsequently release the lock member 15, the flexible arm operating piece 18 is pushed downwardly as shown in FIG. 4 to return the lock member 15 to the temporary engaging position as shown in FIG. 2.

Figure 5:
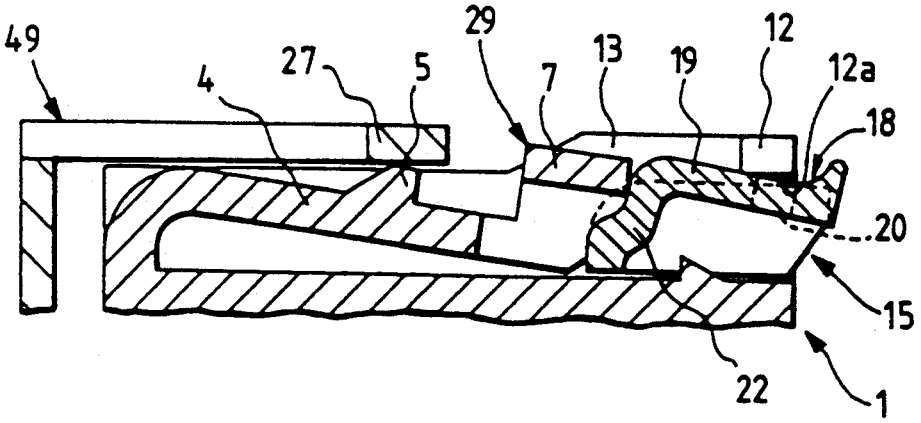
FIG. 5 is a vertical cross sectional view showing the connector incompletely engaged.

FIG. 5 shows the condition of the lock member 15 when the connectors 1 and 49 are incompletely engaged. The flexible arm 4 is deformed when the engaging projection 5 abuts against the upper wall 27 of the accommodating portion to position the ceiling portion 7 inside the accommodating space 13. Therefore, the vertical piece 22 of the lock member 15 interferes with the ceiling portion 7 of push button 29 to prevent the lock member 15 from being inserted into the finally engaged position of FIG. 4. The upper piece portion 19 of the flexible operating piece 18 is maintained in deformed condition under the condition that the engaging projection 20 contacts the lower surface 12*a* of the stopper projection 12. As a result, the operator can easily and visually detect the abnormal condition (incomplete engagement).

Figure 6:
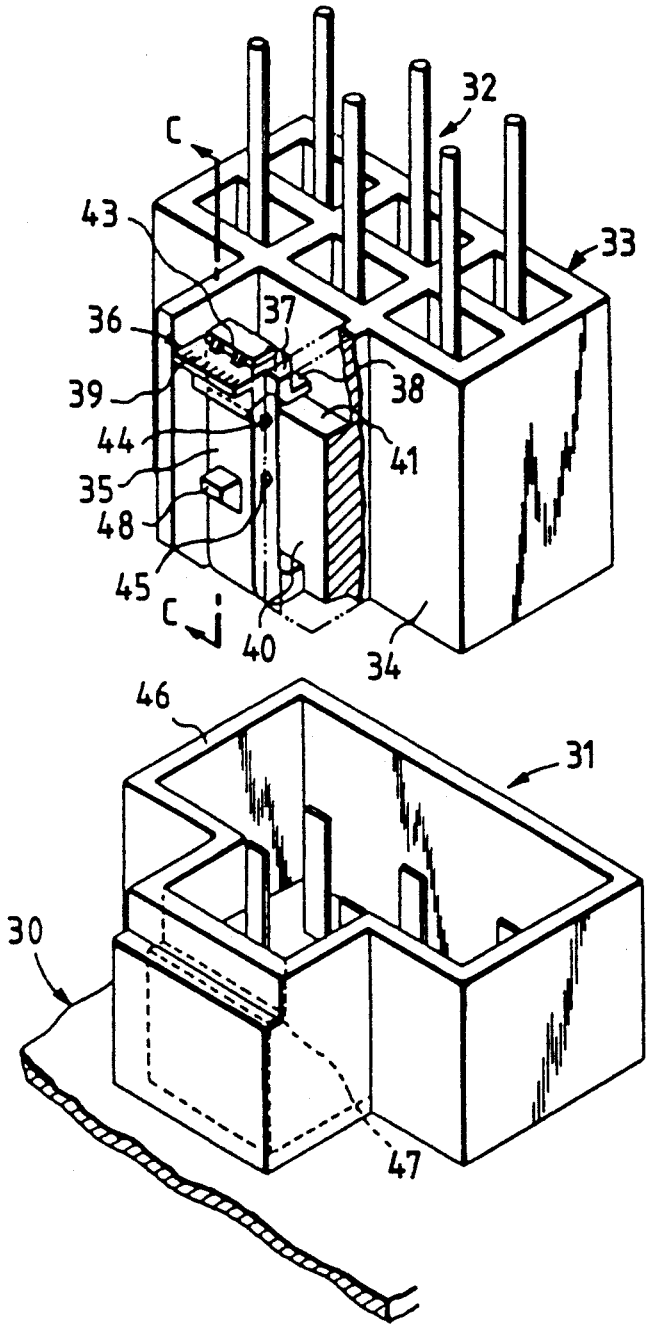
FIG. 6 is a disassembled perspective view showing the second embodiment of the present invention.
Figure 7:
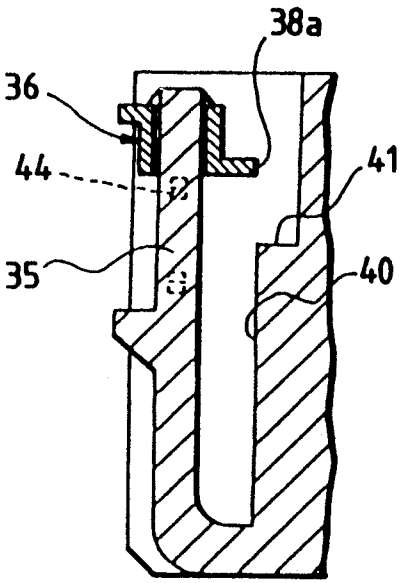
FIG. 7 is a cross sectional view along line C—C in FIG. 6.

As shown in FIGS. 6 and 7, the second embodiment of the present invention, in this embodiment, a male connector 32 is engaged with a female connector 31 installed in the electrical connector box 30 from the above. A square annular lock member 36 is slidably engaged with a L-shaped flexible arm 35, from an end portion to intermediate portion thereof, formed on an outer wall 34 of a connector housing made of a synthetic resin.

The lock member 36 is provided with a lock protrusion portion 38 extending in the deformable direction of the flexible arm 35 and an operating protrusion portion 39 at the opposite side for the square annular portion 37. A stepped portion 41 corresponding to the lock protrusion portion 38 is formed on a protruded outer wall 40 of the male connector housing 33 opposing the flexible arm 35. In this structure, the lock protrusion portion 38 is profiled so that an end portion 38*a* thereof substantially reaches the protruded outer wall 40 as shown in FIG. 7 and the stepped portion 41 is profiled so that the lock protrusion portion 38 does not interfere with the stepped bottom portion 42 when the flexible arm 35 is deformed as later shown in FIG. 8. The flexible arm 35 is provided with a retention projection 43 (see FIG. 6) at its end portion, a temporary engaging projection 44 and stopper projection 45 at its intermediate portion in sequence for the lock member 36. Additionally, an engaging projection 48 corresponding to the engaging recess 47 of the mating female connector housing 46 is provided below the stopper projection 45. Specifically, the retention projection 43 is provided at the end portion of flexible arm 35 to retain the lock member thereon. The retention projection 43 is formed by press-molding or the like after the lock member 36 has been slid onto the flexible arm 35. In FIGS. 6 and 7, the lock member 36 is temporarily engaged in contact with the temporary engaging projection 44.

Figure 8:
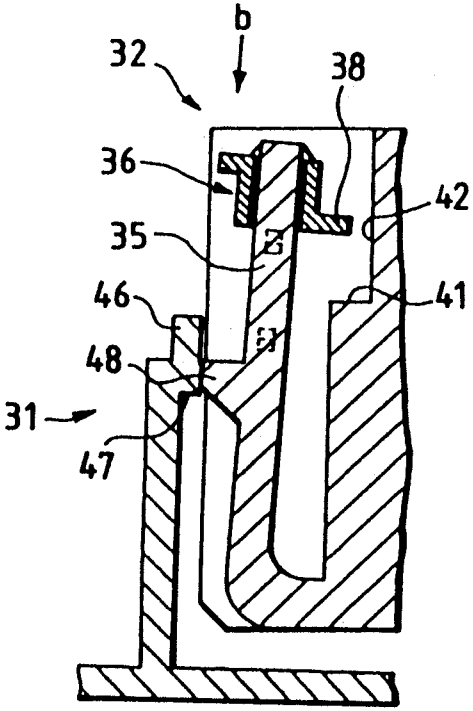
FIG. 8 is a vertical cross sectional view showing the connector second embodiment incompletely engaged.

FIG. 8 shows the connectors 31 and 32 incompletely engaged with each other. The flexible arm 35 is deformed inwardly with the engaging projection 48 of the flexible arm 35 being incompletely engaged with the engaging recess 47 of the female connector housing 46. In this position, even if one were to attempt to slide the lock member 36 by pushing it in the direction indicated with the arrow "b", the lock protrusion 38 would contact the stepped portion 41 so that incomplete engagement of the lock member could be detected.

Figure 9:
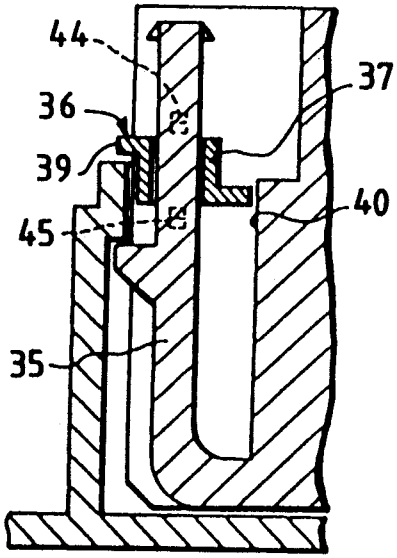
FIG. 9 is a vertical cross sectional view showing the connector second embodiment prevented from releasing of lock condition.
Figure 10:
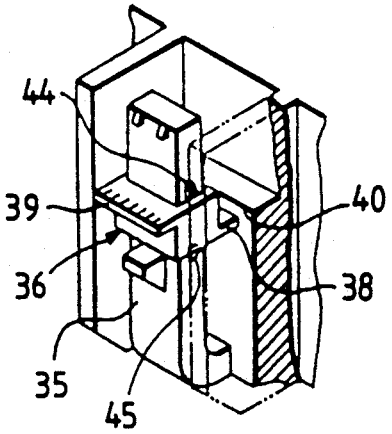
FIG. 10 is a perspective view of the principal portion.
Figure 11:
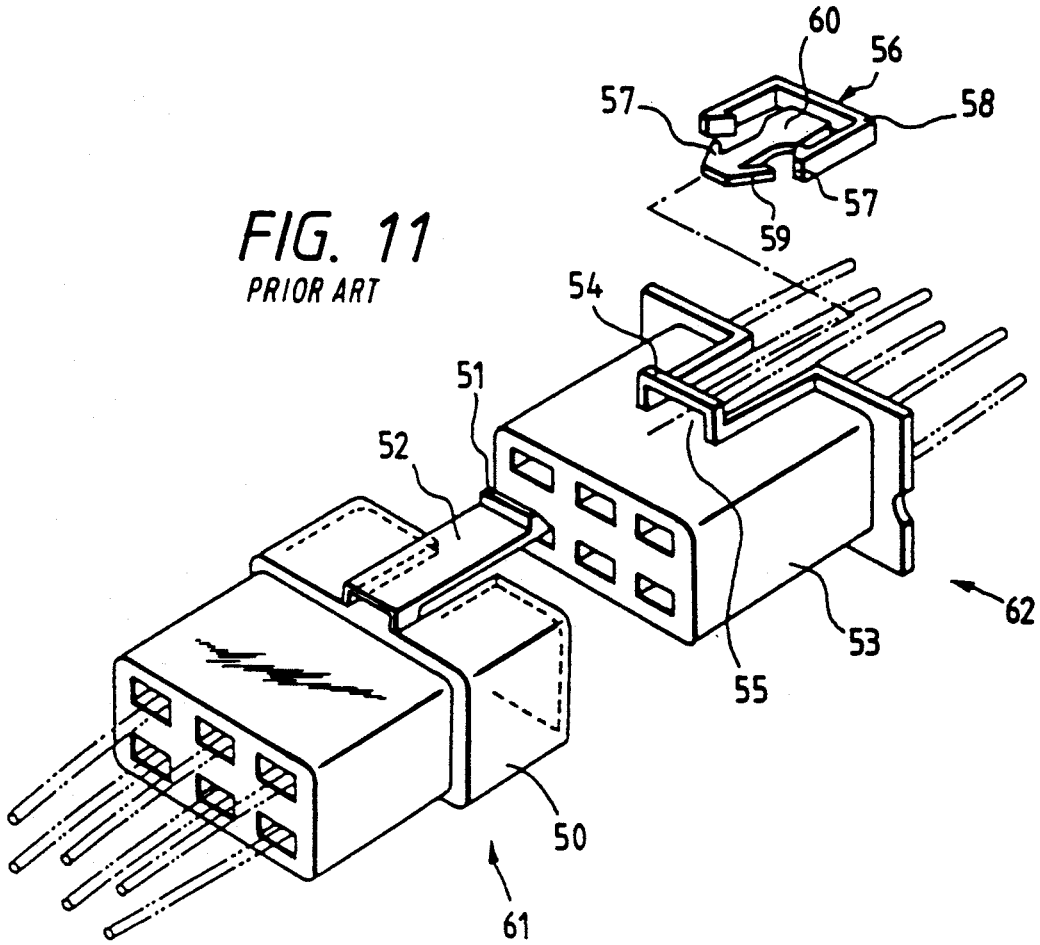
FIG. 11 PRIOR ART
FIG. 11 is a disassembled perspective view showing the conventional connector.
Figure 12:
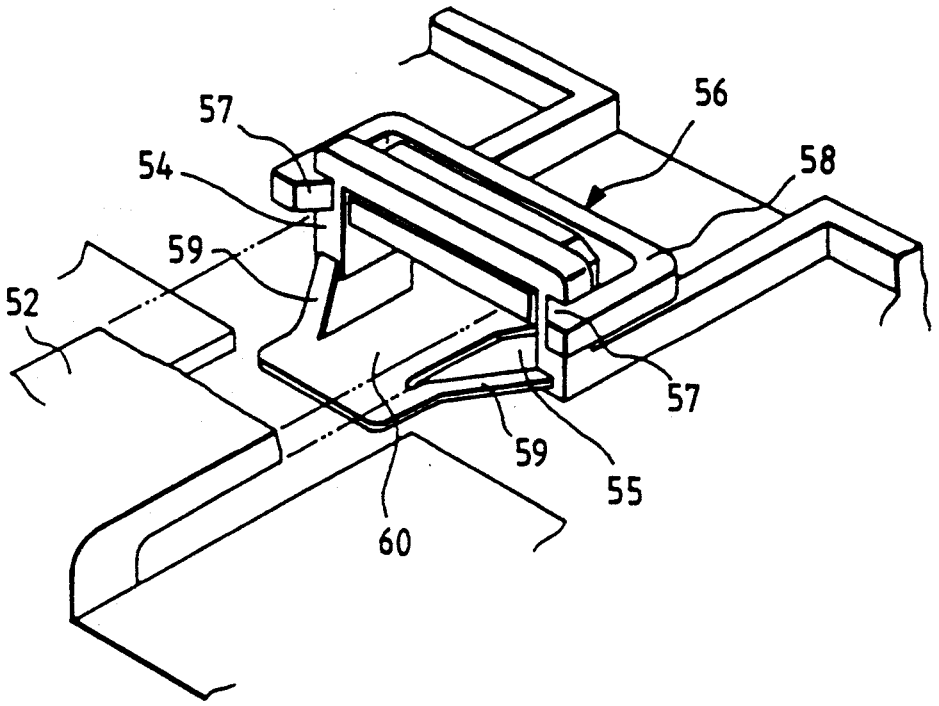
FIG. 12 PRIOR ART
FIG. 12 is a perspective view showing the principal portion of conventional connector prevented from releasing of lock condition.

FIGS. 9 and 10 show complete engagement of the connector. In this position, lock member 36 can be slid beyond the temporary engaging projection 44 so as to contact the stopper projection 45 as the lock protrusion 38 is maintained in contact with the protruded outer wall 40. The back member is held between the stopper projection 45 and the temporary engaging projection 44 (complete engagement position) to prevent the deformation of the flexible arm 35 and the release of the lock condition. When the lock member 36 is released, the square annular portion 37 is returned to the temporary engaging position beyond the temporary engaging projection 44 by pulling back the operating projection 39.

As described above, the present device prevents missing of the lock member since the lock member is slidably engaged with the connector and releasing of the lock by simple operations. Also, the lock member can be easily released and the connector can be easily disconnected for maintenance work. In addition, incomplete engagement of the connector can be prevented and therefore a failure such as to incomplete electrical connection due to inadvertent disconnection of the connector can be eliminated.

What is claimed is:

1. A connector, comprising:

a pair of connector housings, one connector housing including a flexible arm having an engaging projection, the other connector housing including an engaging portion adapted to be engaged by said engaging projection when said pair of connector housings are connected to one another; and a locking member for preventing said engaging projection from being disengaged from said engaging portion by moving said locking member from a temporary engaging position to a completely engaging position at which said locking member prevents said flexible arm from being flexed, wherein said one connector housing includes a stopper projection thereon and said locking member including a flexible locking arm having an engaging portion corresponding to said stopper projection, and wherein said locking member is moveable from said temporary engaging position to said completely engaging position by bending said flexible locking arm to enable said locking member to be moved such that said engaging portion is moved from one side of said stopper projection to the other side thereof.

2. A connector, comprising:

a pair of connector housings, one connector housing including a body portion and a flexible arm extending from said body portion and having an engaging projection, the other connector housing including an engaging portion adapted to be engaged by said engaging projection when said pair of connector housings are connected to each other, said one connector housing including an accommodating space partially defined by said flexible arm and a stepped portion provided in said body portion; and lock release prevention means, accommodated in said accommodating space, for preventing said engaging projection from being disengaged from said engaging portion by moving said lock release prevention means from a temporary engaging position to a completely engaging position, wherein said lock release prevention means includes a lock member slidably disposed on said flexible arm and having a protrusion, which, when moved from said temporary engaging position toward said completely engaging position, contacts said stepped portion when said flexible arm is in a deformed position and contacts an outer surface of the other connector when said flexible arm is in a released, non-deformed, position.

3. A connector, comprising:

a first connector housing including a body portion and a flexible arm extending from said body portion to define a space therebetween, said flexible arm having an engaging projection;

a second connector housing including an engaging portion adapted to be engaged by said engaging projection when said pair of connector housings are connected to one another, said flexible arm being temporarily deflected during engagement of said engaging projection with said engaging portion and disengagement therefrom;

a locking member slidably disposed on said flexible arm and being at least partially disposed in said space, said locking member being moveable from a first position in which said flexible arm can be deflected to a second position which prevents said flexible arm from being deflected, wherein when said connector housings are locked together by engagement of said engaging projection of said flexible arm with said engaging portion of said second connector housing, said locking member is disposed in said second position to prevent flexing of said locking member so as to attendantly prevent disengagement of said engaging projection from said engaging portion.

4. The connector of claim 3, wherein said body portion includes an outer surface having a recessed portion partially defining said space, said locking member being disposed adjacent said recessed portion when in said first position.

5. The connector of claim 3 wherein said flexible lock arm includes a retaining projection at an end thereof for retaining said locking member thereon.

* * * * *